United States Patent [19]

Paton et al.

[11] Patent Number: 4,656,322

[45] Date of Patent: Apr. 7, 1987

[54] ELECTRICAL SWITCHING DEVICE

[75] Inventors: Charles R. Paton, New Brighton; Lawrence B. St. Clair, Beaver, both of Pa.

[73] Assignee: Westinghouse Electric Corp., Pittsburgh, Pa.

[21] Appl. No.: 817,361

[22] Filed: Jan. 9, 1986

[51] Int. Cl.[4] ..... H01H 9/20

[52] U.S. Cl. ..... 200/50 A

[58] Field of Search ..... 200/50 A, 43.07, 43.16, 200/43.19, 43.21, 43.14

[56] References Cited

U.S. PATENT DOCUMENTS

| | | | |
|---|---|---|---|
| 1,489,712 | 4/1924 | Platt | 200/50 A |
| 2,079,286 | 5/1937 | Hammerly | 200/50 A |
| 2,645,688 | 7/1953 | DeSmidt et al. | 200/50 A |
| 2,695,934 | 11/1954 | Wills | 200/50 A |
| 2,770,688 | 11/1956 | Johnson | 200/50 A |
| 2,806,099 | 9/1957 | Rexroad | 200/50 A |
| 2,890,302 | 6/1959 | De Benedictis | 200/50 A |
| 3,179,759 | 4/1965 | Rice et al. | 200/43.14 |
| 3,312,794 | 4/1967 | Hollyday | 200/43.15 |
| 4,168,416 | 9/1979 | Josemans | 200/43.04 |
| 4,180,716 | 12/1979 | Suzuki | 200/320 |
| 4,291,207 | 9/1981 | Reinke et al. | 200/43.04 |

FOREIGN PATENT DOCUMENTS

| | | |
|---|---|---|
| 46480 | 5/1982 | European Pat. Off. . |
| 2390569 | 1/1979 | France . |

*Primary Examiner*—J. R. Scott

*Attorney, Agent, or Firm*—L. P. Johns

[57] ABSTRACT

An electrical switching device characterized by an enclosure containing a switch operable between ON and OFF positions by a handle releasably lockable in the OFF position; the handle being disposed between the enclosure and a handle guard, the guard having an opening, the handle having a tab engaging a shoulder surface in the opening when in the OFF position; an interlock plate for releasably latching an enclosure cover in place and the plate being releasable by movement of the handle in the OFF position; and the handle being movable to the ON position only by manipulation of the interlock plate, whereby accidental movement of the handle is avoided.

6 Claims, 5 Drawing Figures

FIG. 1
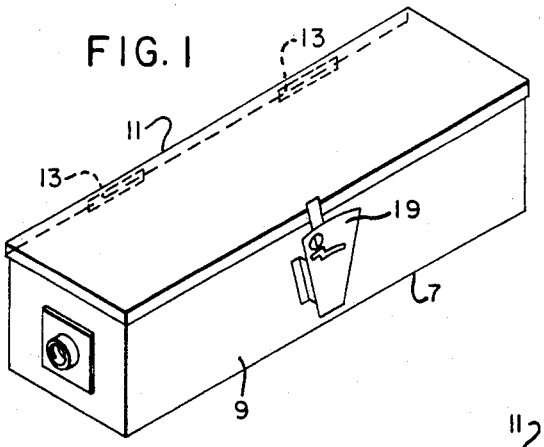
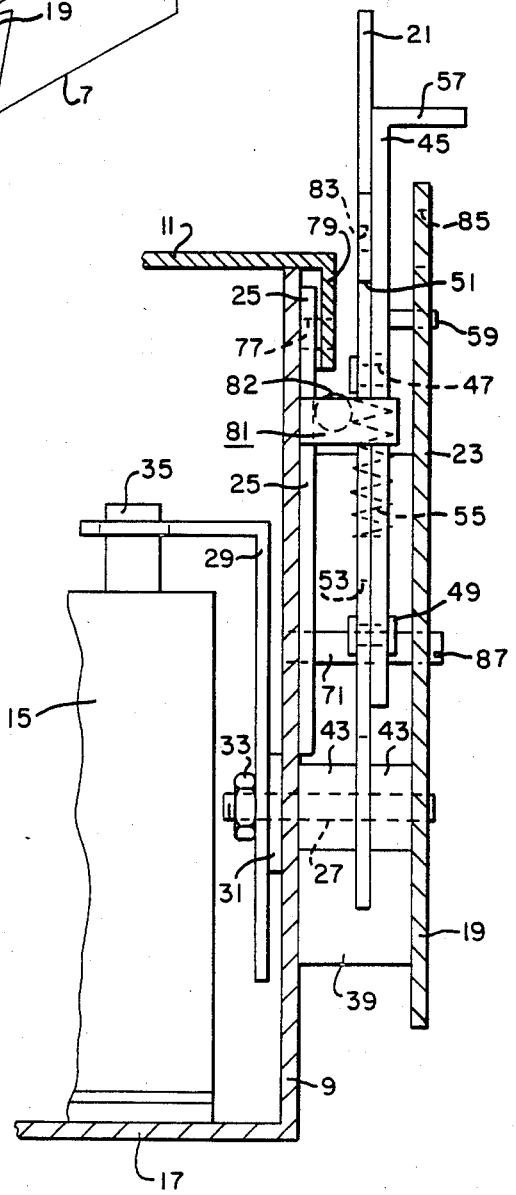
FIG. 3

ELECTRICAL SWITCHING DEVICE

BACKGROUND OF THE INVENTION

1. Field of the Invention

This invention relates to an electrical switching structure and, more particularly, it pertains to an interlock assembly for minimizing accidental turning-on of a switch.

2. Description of the Prior Art

Although interlocking switch operators of various types exist in the prior art, such prior operators have not included interlocking mechanisms necessary for greater safety in the electrical tool switches including automatic locking in the off position only to prevent unauthorized operation of a handle from OFF to ON position without sacrificing operation from on to off positions.

Where in addition the switch is contained within an enclosure having a removable cover, there is an advantage having the cover locked whether the actuating handle for the switch is in the OFF or ON position. Normally for reasons of safety it is desirable that the cover be unlocked only when the operating handle for the switch is in the OFF position. For this reason there has been a need for providing a handle that not only actuates the switch to the open position, but with a further handle movement also unlocks the cover with an additional movement of the handle in the OFF position.

SUMMARY OF THE INVENTION

In accordance with this invention, an electrical switching device is provided for avoiding inadvertent turn on of a switch which device includes an enclosure containing electrical switching contacts operable between ON and OFF positions, the enclosure having side walls forming an open side; a cover for the open side removably mounted on the enclosure and having an interlock pin; a rotatable switch shaft for operating the contacts with an outer shaft portion extending through one side wall; an interlock plate pivotally mounted on said one side wall for movement between locked and unlocked positions of the interlock pin and biased in the locked position; a handle joined to the outer portion of the shaft for manual rotation of the shaft; the handle being movable between ON and OFF positions of the contacts and also movable against the interlock plate to move the plate to the unlocked position; a handle guard attached to the enclosure and disposed over a portion of the handle; the handle having a generally arcuate opening including a first portion on a firt radius in relation to the shaft and a second arcuate portion on a second radius less than the first radius in relation to the shaft with a radial portion interconnecting a first extremity of the first and second portions; the first portion extending toward the ON position of the handle movement and the second portion extending toward the OFF position of the handle movement; and the interlock handle having a tab extending into the opening and being biased in the second portion; whereby manual movement of the tab is required to release the handle from the OFF position.

The advantage of the device of this invention is that it provides a positive ON mechanism which is incorporated into a handle assembly and handle guard which provide dual functions of releasably interlocking the handle against inadvertent closing of the switch contacts and unlatching a cover from the locked position on an enclosure for the switch.

BRIEF DESCRIPTION OF THE DRAWINGS

FIG. 1 is an isometric view of an enclosure for an electrical switch having an access cover and an interlock mechanism;

FIG. 3 is a vertical sectional view taken on the line III—III of FIG. 2;

DESCRIPTION OF THE PREFERRED EMBODIMENT

Figure 2:
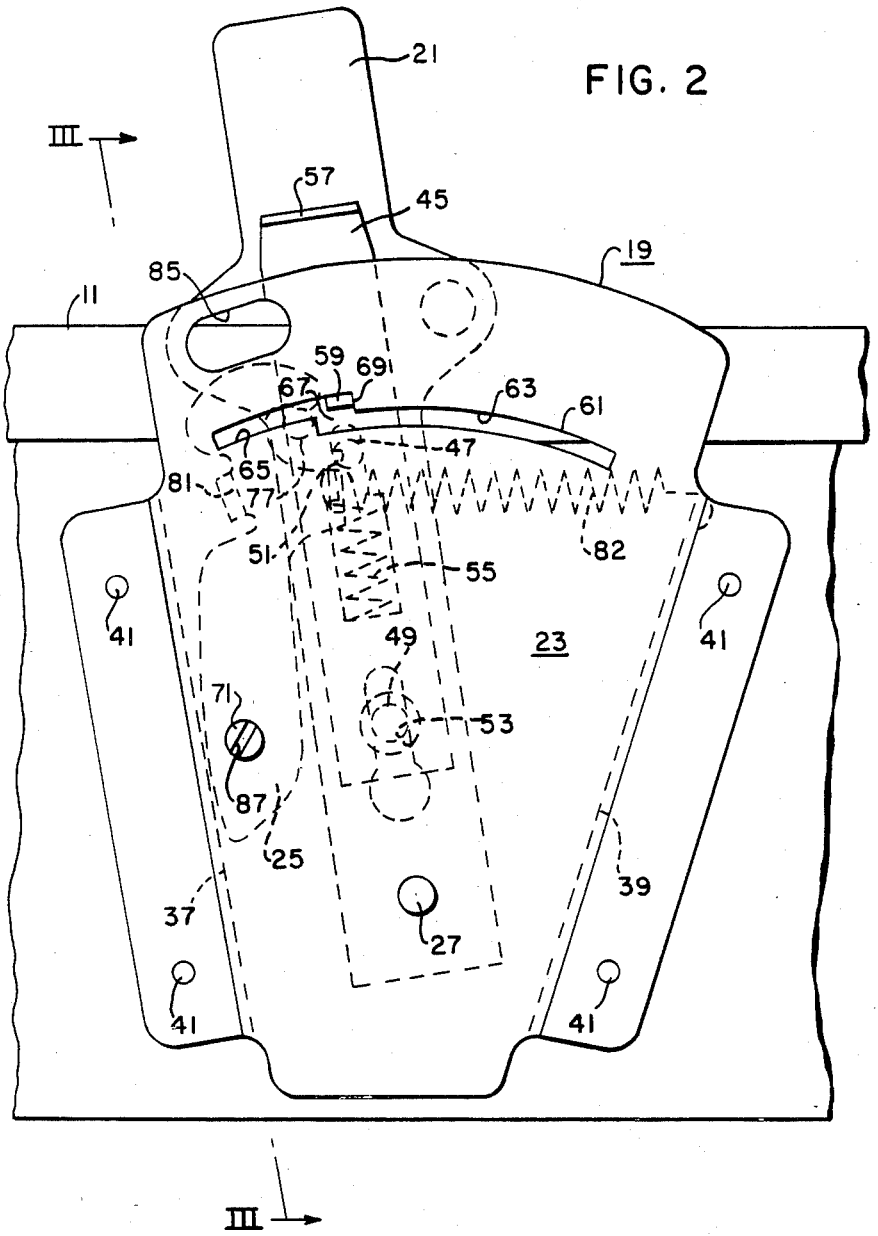
FIG. 2 is an elevational view of the interlock mechanism in the off position of the contacts and in the locked position of the access cover.
Figure 4:
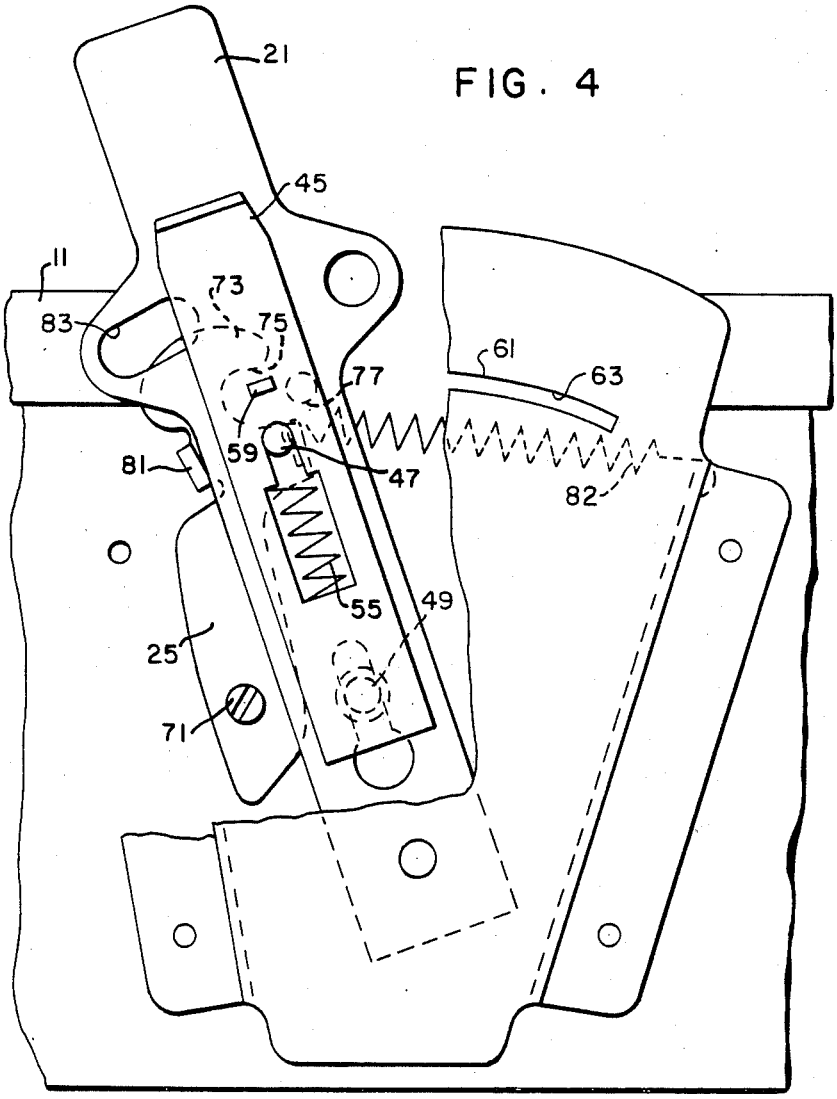
FIG. 4 is an elevational view with portions broken away showing the handle in the unlocked position of the access cover.

An enclosure or box is generally indicated at 7 (FIG. 1) for containing electrical switch apparatus (not shown). The box 7, having a plurality of side walls including a wall 9, includes an upper opening which is closed by a cover 11 which is hingedly mounted on spaced hinges 13 on one of the side walls. The box 7 is adapted to contain electrical switch apparatus or circuit breaker 15 (FIG. 3) which contains separable contacts and which is mounted on a bottom wall 17 of the box. In addition, the box 7 includes an interlock mechanism 19 mounted on the side wall 9.

The interlock mechanism 19 is shown more particularly in FIGS. 2–5 and it includes a handle 21, a handle guard 23, and an interlock plate 25. The handle 21 is fixedly mounted on a shaft 27 having an outer end seated in the handle guard 23 and an inner end extending through the wall 9. The inner end portion of the shaft 27 has an arm 29 securely mounted on the shaft between a washer 31 and a nut 33. In this manner the arm 29 is movable with the handle 21 to move a handle 35 of the switch apparatus or circuit breaker 15 between ON and OFF positions. The handle guard 23 includes a pair of side flanges 37, 39 by which the handle guard is mounted on the side wall 9 in a suitable manner such as by rivets 41.

As shown more particularly in FIG. 3, the handle guard 23 is spaced from the side wall 9 to provide space in which the handle 21 and interlock plate 25 are suitably disposed. For that purpose spacers 43 are mounted on the shaft 27 for maintaining the handle 21 in the desired space relation with respect to the handle guard and the interlock plate. The handle 21 is rotatable between an ON position (FIG. 5) and an OFF position (FIG. 2) of the contacts (not shown) in the switch apparatus or circuit breaker 15. The handle 21 includes a slide 45 which is slidably mounted on the handle to which it is secured by spaced rivets 47, 49. The rivets are secured to the slide 45 and extend through elongated slots 51, 53 in the handle. A coil spring 55 is disposed in the slot 51 for applying pressure to the rivet 47 for biasing the slide in an uppermost position with respect to the handle 21. The slide includes a slide handle 57 for depressing the slide against the spring 55. The slide also includes a tab 59.

The handle guard 23 is a generally pie-shaped plate for enclosing the arc of rotation of the handle 21. The handle guard 23 covers the lower portion of the handle 21 leaving the upper end free for manual movement as required. The handle guard 23 includes an elongated opening or slot 61 including a first arcuate slot portion 63 and a second slot portion 65 having different radii with relation to the shaft 27. A radial portion 67 extends between adjacent end portions of the portions 63, 65. The tab 59 is disposed in the slot 61 including the portions 63, 65, 67. With the handle 21 in the OFF position, the tab 59 is normally disposed under the influence of the spring 55 in the second slot portion 65 and against a shoulder 69 of the second slot portion. In order to move the handle 21 to the ON position, it is necessary to depress the slide handle 57 downwardly against the spring 55 to move the tab 59 into the first slot portion 63 of the slot 61 and away from the shoulder 69, whereupon the handle is movable clockwise to the ON position and to close the contacts in the switch apparatus 15.

Figure 5:
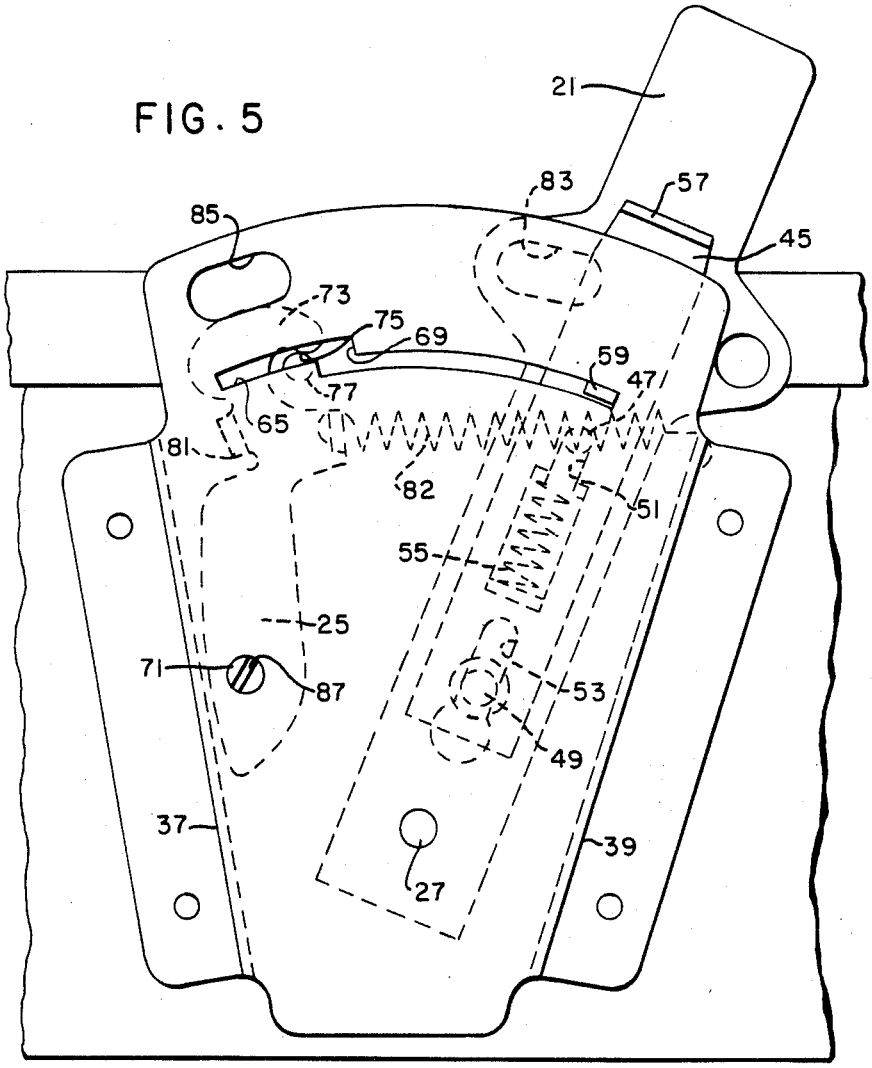
FIG. 5 is an elevational view showing the interlock mechanism in the "ON" position of the handle.

The interlock plate 25 is fixedly mounted on a pin 71 (FIG. 3) having a left-end portion pivotally mounted in the side wall 9 and a right end portion extending through the handle guard 23. The plate includes a hook portion 73 providing a notch 75 for engaging an interlock pin 77 which is fixedly mounted on a down-turn flange 79 (FIG. 3) of the cover 11. As shown, the interlock plate 25 is disposed between the wall 9 and the flange 79. A coil spring 81 extends between the plate 25 and the side flange 39 for retaining the plate 25 in the interlock position (FIG. 5).

To disengage the plate 25 from the interlock pin 77, the handle 21 is rotated counterclockwise from the OFF position (FIG. 2) to an unlocked position (FIG. 4) causing the handle to press against a detent 81 (FIG. 3) extending from the interlock plate 25 into the path of movement of the handle 21. Manifestly, when the handle 21 is in the position shown in FIG. 4, the interlock pin 77 is unlocked and the cover 11 may be opened.

The handle 21 and the handle guard 23 include matching holes 83, 85 which, when aligned as shown in FIG. 2, are adapted to receive the shackle of a padlock to prevent movement of the handle 21 to the ON position.

In the event of an emergency, the interlock plate 25 may be moved counterclockwise against the spring 82 by insertion of a screwdriver into a slot 87 in the outer end of the pin 71.

In conclusion, the electrical switching device of this invention is unique in that all of the interlock structures are located within the handle guard and that the "positive ON" slide must be defeated before the switch apparatus can be turned ON. Finally, the interlock structure includes means for latching and unlatching a cover for an enclosure in which the switch structure is enclosed.

What is claimed is:

1. An electrical switching device having an arrangement to minimize inadvertent turning ON and comprising:

an enclosure containing a switch having a switch handle;

a rotatable switch shaft coupled to the switch handle with an outer shaft portion extending outside the enclosure;

an operating handle joined to the outer portion of the shaft for manual rotation of the shaft;

a guard for the handle disposed over a first portion of the handle and attached to the enclosure, the operating handle also having a second portion extending out from the guard to enable manual operation of the handle;

an operating handle slide slidably mounted and retained on the handle facing the guard, the interlock handle slide having a tab extending away from the handle and extending through an opening in the handle guard;

the handle guard having an opening including a generally arcuate configuration with a first arcuate slot portion on a first radius in relation to the shaft and a second arcuate slot portion on a second radius less than the first radius in relation to the shaft with a shoulder portion interconnecting the first and second arcuate slot portions;

slide spring means interconnecting the handle and the interlock handle slide for normally, in the absence of manual force, biasing the slide in a direction toward one of the first and second arcuate slot portions;

the switch having the OFF position when the operating handle is turned so that the tab of the interlock handle slide is in one of the first arcuate slot portions of the handle guard opening; and the switch having the ON position when the operating handle is turned so the tab of the interlock handle slide is in the other of the second arcuate slot portion of the handle guard opening.

2. An electrical switching device of claim 1 in which the operating handle slide has a slide extension extending away from the handle for permitting manual operation of the slide in a direction parallel to the handle.

3. An electrical switching device of claim 2 in which:

an interlock plate located under the handle guard between the handle and the enclosure mounted for pivotal movement about a pin extending from the enclosure, the pin being located proximate a side of the handle guard toward which the first arcuate slot portion of the handle guard opening extends, the interlock plate having an interlock plate tab that is located so the handle strikes the plate tab and rotates the plate about the pin during motion of the handle with the slide tab in the first arcuate slot portion of the handle guard opening, and an interlock plate spring biasing the plate toward a second side of the handle guard;

the interlock plate being operatively associated with the handle and the handle slide so the switch is latched in an OFF position when the handle is moved with the slide tab at the first arcuate slot portion of the handle guard opening; and the interlock pin extending through the handle guard to permit manual change of the interlock plate from a latched OFF position to an unlatched OFF position.

4. An electrical switching device of claim 3 in which the interlock plate includes a pin receiving notch and including an interlock spring biasing the interlock plate in a direction for interlocking the pin in the notch.

5. An electrical switch device having an arrangement to minimize inadvertent turning ON and comprising:

an enclosure containing electrical switch operable between ON and OFF positions, the enclosure having side walls forming an open side;

a cover for the open side removably mounted on the enclosure and having an interlock pin;

a rotatable switch shaft for operation of the switch with an outer shaft portion extending through one side wall;

an interlock plate pivotally mounted on said one side wall for movement between locked and unlocked positions of the interlock pin and biased in the locked position;

a handle joined to the outer portion of the shaft for manual rotation of the shaft;

the handle being movable between ON and OFF positions of the switch and also movable against the interlock plate to move the plate to the unlocked position;

a handle guard attached to the enclosure and disposed over a portion of the handle;

the handle guard having a generally arcuate opening including a first arcuate slot portion on a first radius in relation to the shaft and a second arcuate slot portion on a second radius less than the first radius in relation to the shaft with a shoulder portion interconnecting a first extremity of the first and second arcuate slot portions;

a first arcuate slot portion extending toward the ON position of the handle movement and the second arcuate slot portion extending toward the OFF position of the handle movement; and the handle having a tab extending into the opening and being biased in the second arcuate slot portion; whereby manual movement of the handle is required to release the handle from the OFF position.

6. The electrical switching device of claim 5 in which the interlock plate is fixedly mounted on a pivot pin which pin is manually rotatable independently of the handle for unlocking the plate from the interlock pin.

* * * * *